US007196682B2

(12) United States Patent
Lo

(10) Patent No.: US 7,196,682 B2
(45) Date of Patent: Mar. 27, 2007

(54) DRIVING APPARATUS AND METHOD FOR ACTIVE MATRIX ORGANIC LIGHT EMITTING DISPLAY

(75) Inventor: Shin-Tai Lo, Miaoli (TW)

(73) Assignee: Wintek Corporation, Taichung (TW)

( * ) Notice: Subject to any disclaimer, the term of this patent is extended or adjusted under 35 U.S.C. 154(b) by 638 days.

(21) Appl. No.: 10/671,503

(22) Filed: Sep. 29, 2003

(65) Prior Publication Data

US 2005/0068274 A1 Mar. 31, 2005

(51) Int. Cl.
*G09G 3/32* (2006.01)

(52) U.S. Cl. ..... 345/82; 345/76; 345/204; 315/169.3

(58) Field of Classification Search ..... 345/76–82, 345/169.1, 169.3, 169.4
See application file for complete search history.

(56) References Cited

U.S. PATENT DOCUMENTS 6,229,506 B1 5/2001 Dawson et al.
6,847,340 B2 * 1/2005 Wang et al. ..... 345/76
2002/0196213 A1 * 12/2002 Akimoto et al. ..... 345/82
2004/0046719 A1 * 3/2004 Wang et al. ..... 345/82
2004/0140835 A1 * 7/2004 Lehmann et al. ..... 327/208
2004/0150595 A1 * 8/2004 Kasai ..... 345/82
2004/0201557 A1 * 10/2004 Lo et al. ..... 345/82
2005/0007357 A1 * 1/2005 Yamashita et al. ..... 345/204
2005/0068271 A1 * 3/2005 Lo ..... 345/76
2005/0078067 A1 * 4/2005 Akimoto et al. ..... 345/82
2005/0168457 A1 * 8/2005 Akimoto et al. ..... 345/204

* cited by examiner

*Primary Examiner*—Richard Hjerpe
*Assistant Examiner*—Kimnhung Nguyen
(74) *Attorney, Agent, or Firm*—Birch, Stewart, Kolasch & Birch, LLP

(57) ABSTRACT

A driving apparatus and method for active matrix organic light emitting display includes a writing element, an auto-zero element, a driving element, a switching element and a storage element. The invention employs an auto-zero mechanism to compensate threshold voltage variations of each driving element to improve image uniformity. Data loading is accomplished by charging the storage element with a current. Loading voltage may be modulated by controlling the amount of current and by controlling charging time. The invention saves a capacitor than conventional techniques, and can increase the aperture ratio of pixels and reduce the complexity of driving method.

8 Claims, 4 Drawing Sheets

DRIVING APPARATUS AND METHOD FOR ACTIVE MATRIX ORGANIC LIGHT EMITTING DISPLAY

FIELD OF THE INVENTION

The present invention relates to a driving apparatus and method for active matrix organic light emitting display (AMOLED) and particularly to a driving apparatus and method to improve image uniformity of OLED panels.

BACKGROUND OF THE INVENTION

The methods for driving OLED can be divided into passive matrix OLED (PMOLED) and active matrix OLED (AMOLED). The AMOLED uses thin-film transistors (TFTs) and capacitors to store signals for controlling the brightness and gray scale of the OLED. Although the cost and technical threshold for fabrication of the PMOLED are lower, the products of PMOLED are still limited to about 5 inches in size and the resolution cannot increase due to the constraint of the driving method. Thus they are restricted in the market of low resolution and small dimension. To achieve a higher resolution and a larger screen, active driving method must be used. The active driving method uses capacitors to store signals, so that the pixel can still maintain the original brightness after the scan line scans it. In the passive driving, only the pixel that is selected by the scan line will be lighted. Thus under the active driving method, OLED does not need to be driven to a very great brightness. As a result, it has a longer service life and can achieve a higher resolution. To couple OLED with TFT technology makes active driving of OLED possible, and meets the market demands for the smoothness of display and ever-higher resolution.

The technologies for growing TFT on the glass substrate can be amorphous silicon (a-Si) process and low temperature poly-silicon (LTPS) process. The main differences between LTPS TFT and a-Si TFT are in electricity and manufacturing complexity. LTPS TFT has a higher carrier-mobility which means that TFT can better provide sufficient current, but its manufacturing process is more complicated. By contrast, a-Si TFT has a lower carrier mobility than LTPS, but its manufacturing process is simpler and well developed, and therefore a-Si TFT has a better competitiveness in terms of cost.

Because of the constraints in manufacturing process of LTPS, the TFT elements being fabricated have variations in threshold voltage and electron mobility. As a result, each TFT element has different characteristics. When the driving system adopts analog voltage-modulation to display gray level, even if the input data-voltages are the same, the TFTs generate different output currents such that the OLEDs of different pixels on the display panel will display different brightness due to different characteristics of TFT for different pixels. This phenomenon causes the ill gray level on OLED display panel and severely damages image uniformity of the panel.

To remedy the shortcoming of uneven image uniformity mentioned above, U.S. Pat. No. 6,229,506, entitled "Active Matrix Light Emitting Diode Pixel Structure and Concomitant Method" discloses a pixel circuit that includes 4T2C (4 TFT transistors and 2 capacitor) as shown in FIG. 3. It has an auto-zero mechanism to compensate threshold voltage variations of the TFT elements to improve the image uniformity. Its operating principle is as follows:

The driving time sequence of control signals of the driving circuit is divided in auto-zero phase 410, load data phase 420 and illuminate phase 430. Refer to FIG. 4 for the control signal time sequence based on FIG. 3.

Before entering the auto-zero phase 410, transistor P3 and transistor P4 are OFF, and transistor P2 is ON. In the meantime, current flowing through Organic Light Emitting Diode (OLED) 360 is the current of a preceding frame, and this current is controlled by Vsg of transistor P1 (voltage difference between the source and gate, i.e. the voltage difference between two ends of capacitor element Cs').

After having entered the auto-zero phase 410, transistor P4 is initially ON, and transistor P3 is ON as follow in order to connect the drain and gate of the transistor P1 to form a diode connection. Then transistor P2 is OFF, and the voltage of the gate of transistor P1 will increase to a voltage value which is equal to the high potential (Vdd) subtracts the threshold voltage (Vth) of transistor P1, i.e. the voltage difference between two ends of the capacitor element Cs' is the threshold voltage of transistor P1. Then transistor P3 is OFF, and the threshold voltage (Vth) of transistor P1 is stored in the capacitor element Cs' to fulfill the auto-zero phase operation.

When entering the load data phase 420, if voltage variation on the data line 310 is $\Delta V$, and is connected to the gate of transistor P1 through transistor P4 and capacitor element Cc', the voltage difference between two ends of the capacitor Cs' will be $\Delta V \times [Cc'/(Cc'+Cs')]$ plus Vth originally stored in Cs', i.e. Vsg of transistor P1 will include Vth of transistor P1. Thus current output from transistor P1 relates only to voltage variation $\Delta V$ on the data line 310 without being affected by Vth of the transistor P1 in each pixel.

Finally, entering the illuminate phase 430. Transistor P4 is OFF, and transistor P2 is ON. Transistor P1 will output current of the present frame flowing through OLED 360 to enable OLED 360 element to illuminate.

Although the pixel circuit of 4T2C can compensate variations of the threshold voltage (Vth) of the transistors in each pixel and improve image uniformity of the entire display image, the elements being used include four transistors and two capacitors. As the capacitors take a lot of area in the pixel, aperture ratio of the pixel will decrease significantly. Moreover, in addition to the data line 310, scan line 320 and supply line (Vdd) 350, it also requires control circuits such as auto-zero line 330 and illuminate line 340. The driving method becomes very complicated. Hence it requires non-standard scan driving IC and data driving IC, and fabrication cost is higher.

SUMMARY OF THE INVENTION

Therefore the primary object of the invention is to resolve the aforesaid disadvantages and to overcome the drawbacks of the prior art. The invention may be adopted for LTPS-TFT AMOLED devices to improve image uniformity of AMOLED panels. Moreover, the driving method employed by the invention is less complicated technical wise. And the scan driving IC and data driving IC employed in the conventional PMOLED may be used. Thus fabrication cost may be reduced.

In order to achieve the foregoing object, the driving element provided by the invention includes a writing element, an auto-zero element, a driving element, a switching element and a storage element. The apparatus employs an auto-zero mechanism to compensate variations of threshold voltage of each driving element to improve image uniformity. Compared with the pixel circuit that uses 4T2C, the invention saves one capacitor, and can increase the aperture ratio of the pixel. Complexity of the driving method also may be reduced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
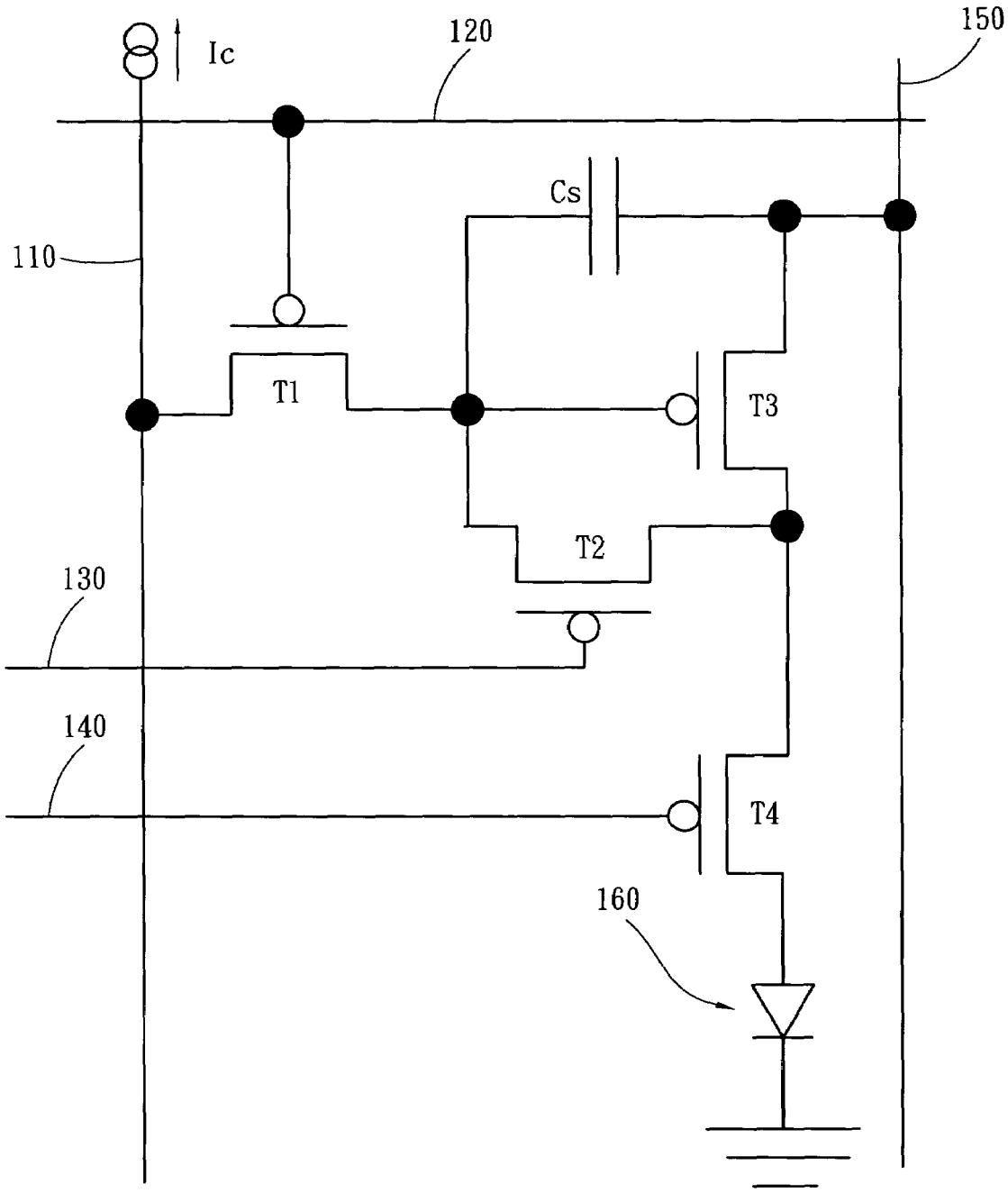
FIG. 1 is a schematic diagram of the invention.

Referring to FIG. 1, the driving apparatus of the invention includes:

a data line 110, a scan line 120, an auto-zero control line 130, a display control line 140, a power supply line 150;

a writing element T1 which has a drain connecting to the data line 110, and a gate connecting to the scan line 120;

an auto-zero element T2 which has a gate connecting to the auto-zero control line 130;

a driving element T3 which has a gate connecting to the source of the writing element T1 and a drain connecting to the source of the auto-zero element T2, and a source connecting to the power supply line 150;

a switching element T4 which has a gate connecting to the display control line 140 and a source connecting to the source of the auto-zero element T2 and the drain of the driving element T3;

a storage element Cs which has two ends, one end connecting to the source of the driving element T3 and the other end connecting to the juncture of the source of the writing element T1, the drain of the auto-zero element T2 and the gate of the driving element T3; and an illuminating element 160 which has one positive end connecting to the drain of the switching element T4 and the other negative end grounded (GND).

The writing element T1, auto-zero element T2, driving element T3 and switching element T4 are respectively a TFT. The storage element Cs is a storage capacitor. The illuminating element 160 is an organic light emitting diode.

Figure 2:
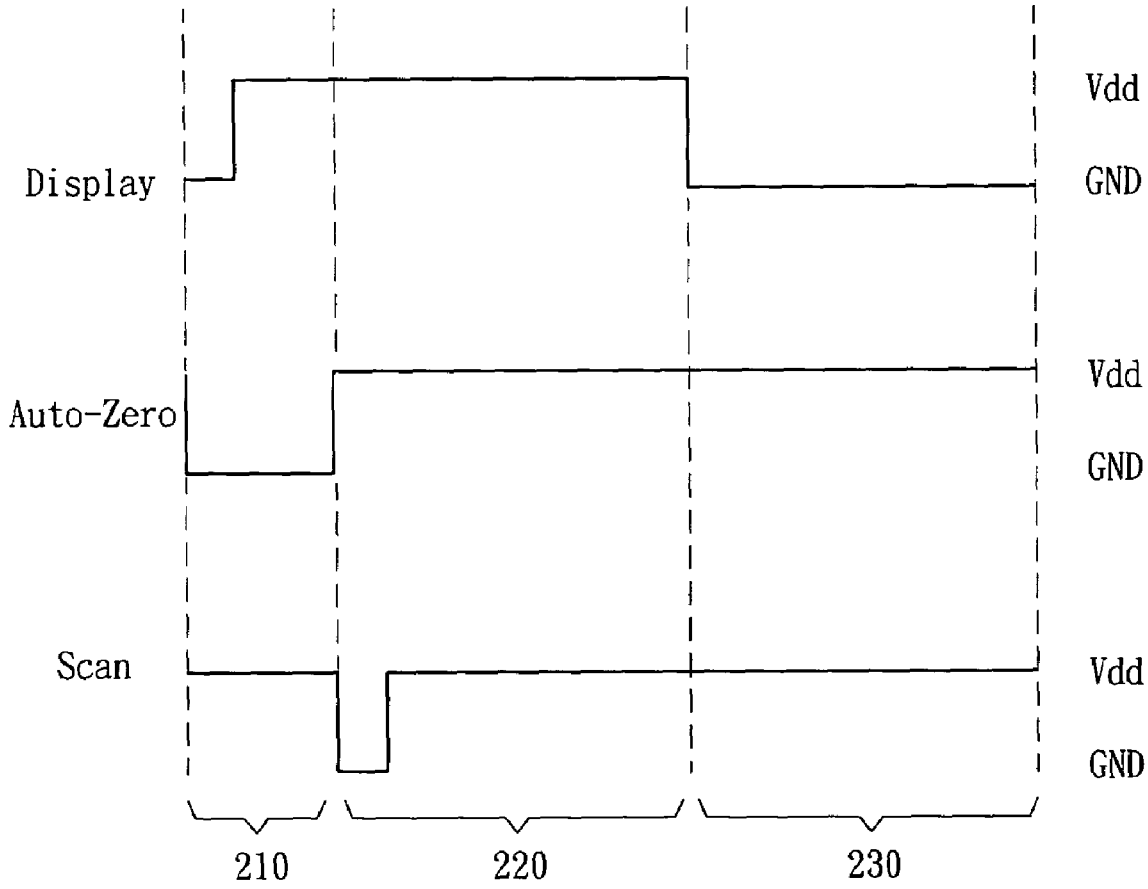
FIG. 2 is a schematic diagram of control signal time sequence of FIG. 1.
Figure 3:
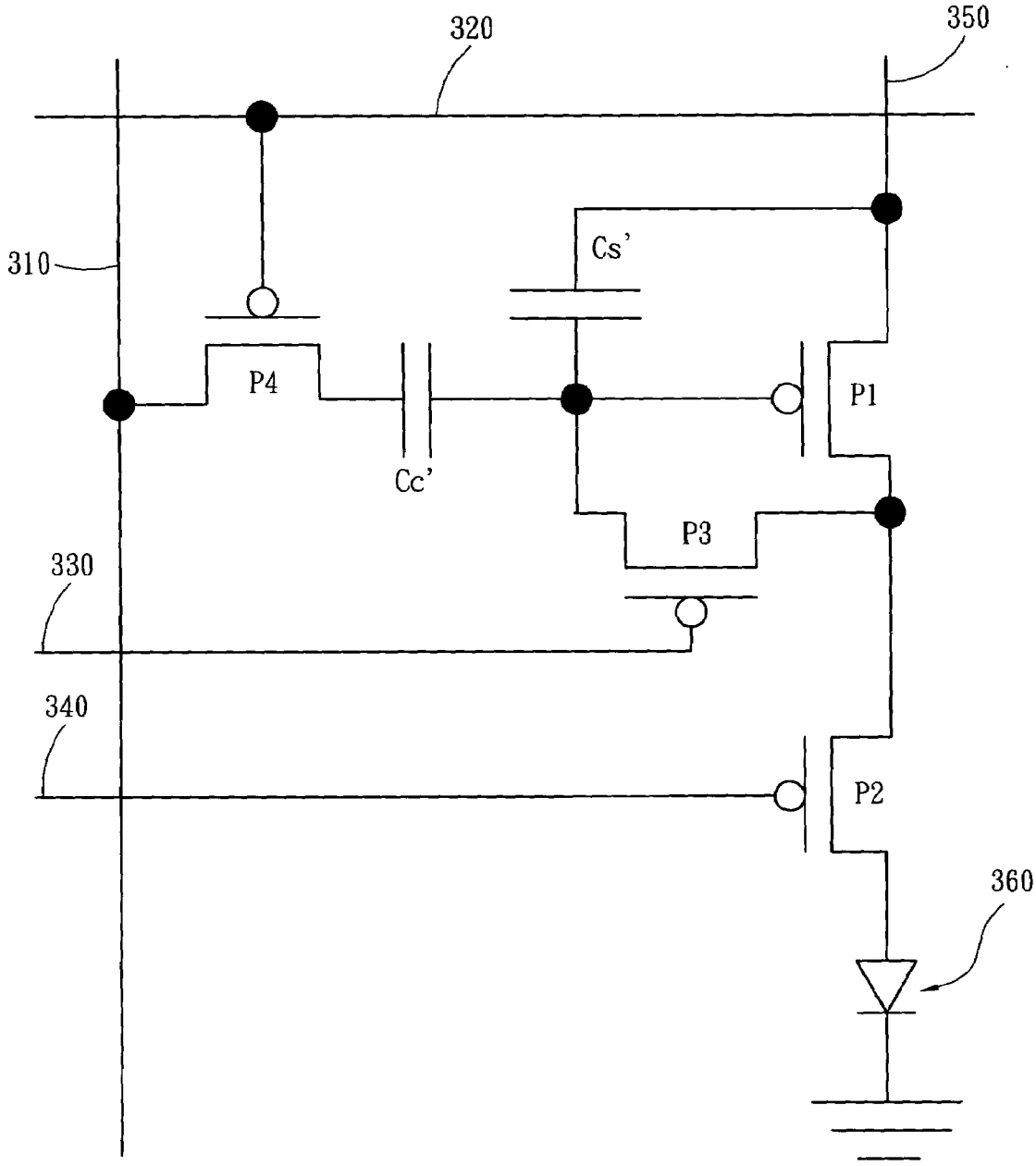
Fig . 3 PRIOR ART
FIG. 3 is a schematic pixel circuit diagram of U.S. Pat. No. 6,229,506.
Figure 4:
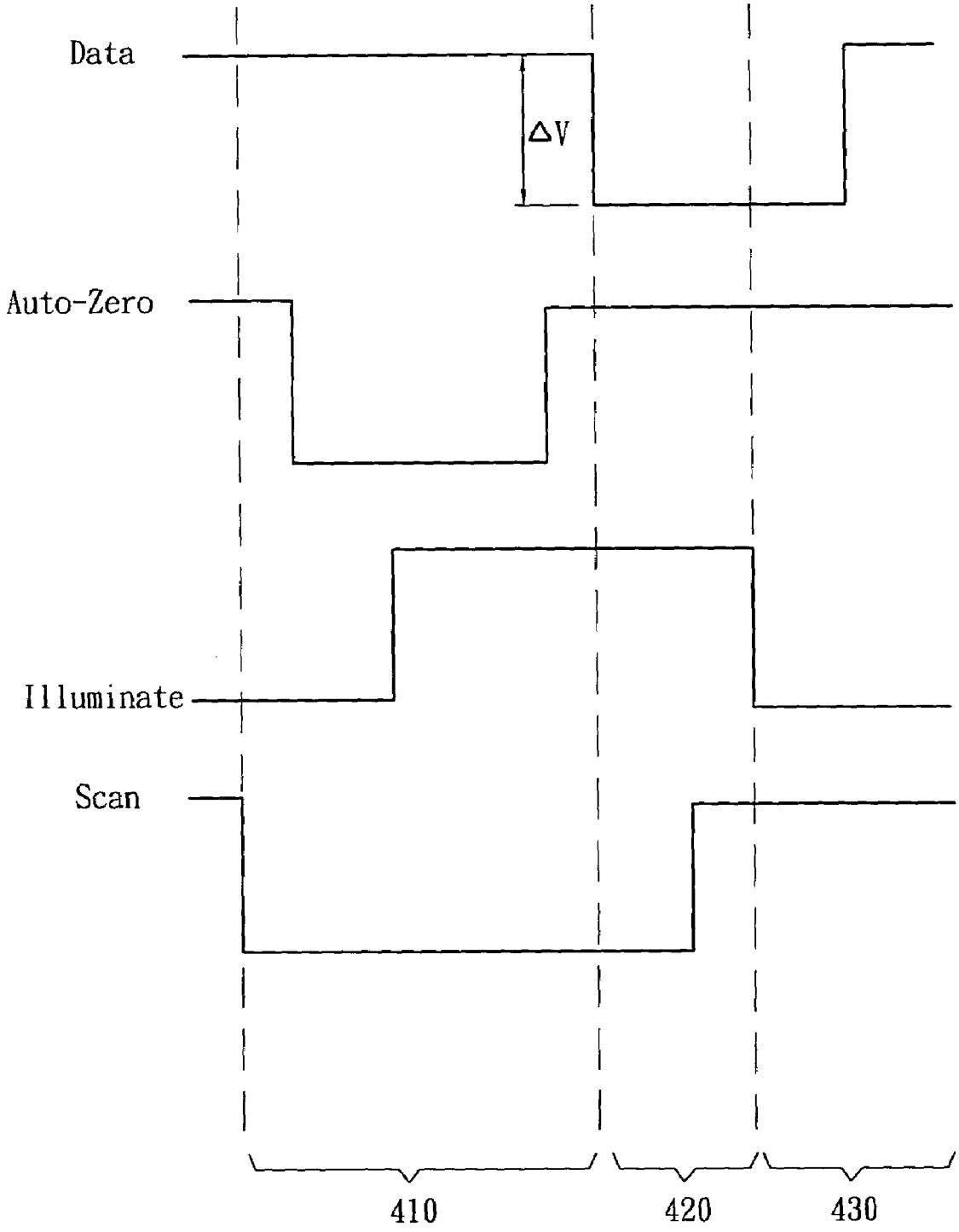
Fig. 4 PRIOR ART
FIG. 4 is a schematic diagram of control signal time sequence of FIG. 3.

Refer to FIG. 2 for the operation principle of the invention that illustrates the control signal time sequence of FIG. 1. The driving time sequence of the invention is divided in an auto-zero phase 210, a scan phase 220 and a display phase 230.

Before entering the auto-zero phase 210, the writing element T1 and the auto-zero element T2 are OFF, and the driving element T3 and the switching element T4 are ON, current flowing through the illuminating element 160 is the current of the preceding frame, the current is controlled by Vsg of the driving element T3 (the voltage difference of the source and the gate, i.e. the voltage difference between two ends of the storage element Cs);

After having entered the auto-zero phase 210, the auto-zero element T2 is ON, and the drain and the gate of the driving element T3 are connected to form a diode connection; then the switching element T4 is OFF; the voltage of the gate of the driving element T3 will increase to a voltage value equal to the high voltage Vdd subtracting the threshold voltage Vth of transistor T3, i.e. the voltage difference between two ends of the storage element Cs is the threshold voltage of the driving element T3, then the auto-zero element T2 is OFF, and the threshold voltage of the driving element T3 is stored in the storage element Cs to complete the auto-zero operation.

Next, enter the scan phase 220. The writing element T1 is ON, the data line 110 provides a "constant current Ic" which charges the storage element Cs. If the charging time of the constant current Ic to the storage element Cs is Tc, the voltage at the gate of the driving element T3 becomes [Vdd−Vth−(Ic×Tc/C) (C is the capacitance of the storage element Cs), i.e. the voltage difference between two ends of the storage element Cs is (Ic×Tc/C) plus the threshold voltage Vth of the driving element T3 originally stored in the storage element Cs. Thus Vsg of the driving element T3 will include the threshold voltage Vth of the driving element T3. Therefore, current output from the driving element T3 relates only to the constant current Ic on the data line 110 and the charging time of the constant current Ic to the storage element Cs without being affected by the variations of the threshold voltage of TFT elements.

Thus, according to the apparatus and method of the invention, by properly modulating the constant current Ic of the data line 110 and charging time Tc of the constant current Ic to the storage element Cs, current output from the driving element T3 may be adjusted and controlled, thereby to control the brightness illuminated by the illuminating element 160. Therefore, using the illuminating element 160 to display the gray scale for the entire picture may be accomplished. In the scan phase 220, writing operation of scan signals starts from the first scan line, and proceeds sequentially until the last scan line.

After signals of each scan line have been written, enter the display phase 230. The switching element T4 is ON, the driving element T3 outputs current of the present frame that also flows through the illuminating element 160 to illuminate a brightness corresponding to the gray scale of image data.

The invention employs an auto-zero mechanism to compensate threshold voltage variations of each transistor element to improve image uniformity. Compared with the 4T2C pixel circuit disclosed in U.S. Pat. No. 6,229,506, the invention provides the following advantages: the invention is a 4T1C pixel circuit. As capacitor takes a great area in a pixel, the invention can save one capacitor than conventional techniques, thus can increase the aperture ratio of the pixel. In addition, the complexity of the driving method may be reduced. And scan driving IC and data driving IC of conventional PMOLED may be used. This helps to reduce the fabrication cost.

What is claimed is:

1. A driving apparatus for active matrix organic light emitting display to display each pixel of a display picture, comprising:

a data line, a scan line, an auto-zero control line, a display control line, a power supply line;

a writing element which has a drain connecting to the data line, and a gate connecting to the scan line;

an auto-zero element which has a gate connecting to the auto-zero control line;

a driving element which has a gate connecting to a source of the writing element and a drain connecting to a source of the auto-zero element, and a source connecting to the power supply line;

a switching element which has a gate connecting to the display control line and a source connecting to the source of the auto-zero element and the drain of the driving element;

a storage element which has two ends, one end connecting to the source of the driving element and other end connecting to a juncture of the source of the writing element, a drain of the auto-zero element and the gate of the driving element; and an illuminating element which has one positive end connecting to the drain of the switching element and the other negative end grounded.

2. The driving apparatus for active matrix organic light emitting display of claim 1, wherein the writing element is a thin film transistor.

3. The driving apparatus for active matrix organic light emitting display of claim 1, wherein the auto-zero element is a thin film transistor.

4. The driving apparatus for active matrix organic light emitting display of claim 1, wherein the driving element is a thin film transistor.

5. The driving apparatus for active matrix organic light emitting display of claim 1, wherein the switching element is a thin film transistor.

6. The driving apparatus for active matrix organic light emitting display of claim 1, wherein the storage element is a storage capacitor.

7. The driving apparatus for active matrix organic light emitting display of claim 1, wherein the illuminating element is an organic light emitting diode.

8. A driving method for active matrix organic light emitting display, comprising steps of:

dividing driving time sequence in an auto-zero phase, a scan phase and a display phase;

setting a writing element and an auto-zero element OFF, and a driving element and a switching element ON before entering the auto-zero phase, allowing a current of a preceding frame to flow through an illuminating element, the current being controlled by Vsg of the driving element (the voltage difference between a source and a gate);

setting the auto-zero element ON after having entered the auto-zero phase, connecting drain and gate of the driving element to form a diode connection, then setting the switching element OFF, raising the voltage of the gate of the driving element to a voltage value equal to a high voltage subtracting the threshold voltage of the driving element, i.e. the voltage difference between two ends of a storage element being the threshold voltage of the driving element, then setting the auto-zero element OFF, and storing the threshold voltage of the driving element in the storage element to complete operations of the auto-zero phase; and entering the scan phase, setting the writing element ON, providing a "constant current Ic" on a data line to charge the storage element for a time period to allow the voltage of the gate of the driving element to become [Vdd−Vth−(Ic×Tc/C) (C being the capacitance of the storage element Cs), i.e. the voltage difference between two ends of the storage element being (Ic×Tc/C) plus the threshold voltage of the driving element originally stored in the storage element so that Vsg of the driving element includes the threshold voltage of the driving element to allow current output by the driving element relating only to the constant current on the data line and the charging time of the constant current for the storage element;

whereby by modulating the constant current of the data line and charging time of the constant current for the storage element, current output from the driving element is adjustable to control the brightness illuminated by the illuminating element.

* * * * *